US010156405B2

(12) United States Patent
Blomgren et al.

(10) Patent No.: US 10,156,405 B2
(45) Date of Patent: Dec. 18, 2018

(54) PLATE HEAT EXCHANGER

(71) Applicant: ALFA LAVAL CORPORATE AB, Lund (SE)

(72) Inventors: Ralf Blomgren, Skanör (SE); Olivier Noël-Baron, Echirolles (FR)

(73) Assignee: ALFA LAVAL CORPORATE AB, Lund (SE)

( * ) Notice: Subject to any disclaimer, the term of this patent is extended or adjusted under 35 U.S.C. 154(b) by 770 days.

(21) Appl. No.: 14/390,186

(22) PCT Filed: Apr. 3, 2013

(86) PCT No.: PCT/EP2013/056990
§ 371 (c)(1),
(2) Date: Oct. 2, 2014

(87) PCT Pub. No.: WO2013/150054
PCT Pub. Date: Oct. 10, 2013

(65) Prior Publication Data

US 2015/0075757 A1 Mar. 19, 2015

(30) Foreign Application Priority Data

Apr. 5, 2012 (EP) ..... 12163320

(51) Int. Cl.
*F28F 3/04* (2006.01)
*F28D 9/00* (2006.01)

(52) U.S. Cl.
CPC ..... *F28F 3/04* (2013.01); *F28D 9/0037* (2013.01); *F28F 3/046* (2013.01); *F28F 2225/00* (2013.01)

(58) Field of Classification Search
CPC ..... F28F 3/04; F28F 3/086; F28F 3/14; F28F 3/08; F28F 3/083; F28F 3/02; F28F 3/022;

(Continued)

(56) References Cited

U.S. PATENT DOCUMENTS 2,877,000 A 3/1959 Person
3,231,015 A 1/1966 Koch
(Continued)

FOREIGN PATENT DOCUMENTS

DE 9309741 U1 8/1993
DE 102005048452 A1 4/2006
(Continued)

OTHER PUBLICATIONS

M. Faizal, Experimental studies on a corrugated plate heat exchanger for small temperature difference applications, Mar. 10, 2011, Experimental Thermal and Fluid Science, 36, p. 5-7.*
(Continued)

*Primary Examiner* — Keith Raymond
*Assistant Examiner* — Nael Babaa
(74) *Attorney, Agent, or Firm* — Buchanan Ingersoll & Ronney PC

(57) ABSTRACT

A plate heat exchanger includes first and second frame plates, and a stack of heat transfer plates. Each heat transfer plate has a peripheral portion encircling a center portion. The heat transfer plates are arranged in pairs between the first and second frame plates, and formed between the pairs of heat transfer plates is a first flow path for a first fluid and a second flow path for a second fluid. One of the first and second flow paths is a free-flow path along which center portions of the heat transfer plates are completely separated from each other. A reinforcement plate is thicker than the heat transfer plates and has a center portion encircled by a peripheral portion. The reinforcement plate is arranged between the first frame plate and the stack of heat transfer plates. Permanent reinforcement joints each bond together the reinforcement plate and an outermost heat transfer plate.

18 Claims, 8 Drawing Sheets

(58) Field of Classification Search
CPC .. F28F 3/025; F28F 3/027; F28F 3/042; F28F 3/044; F28F 3/046; F28F 3/048; F28F 3/10; F28D 9/0037; F28D 9/0062; F28D 1/0308; F28D 9/0006
USPC ..... 165/79
See application file for complete search history.

(56) References Cited

U.S. PATENT DOCUMENTS

| | | | | |
|---|---|---|---|---|
| 3,430,694 | A | 3/1969 | Cardell | |
| 3,590,917 | A | 7/1971 | Huber et al. | |
| 4,053,969 | A | 10/1977 | Bayard | |
| 4,569,391 | A * | 2/1986 | Hulswitt | F28D 9/0037 165/109.1 |
| 5,228,515 | A | 7/1993 | Tran | |
| 5,810,071 | A | 9/1998 | Pavlin | |
| 5,823,247 | A * | 10/1998 | Weibler | F28D 9/0037 165/166 |
| 6,397,940 | B1 * | 6/2002 | Blomgren | B21D 53/04 165/166 |
| 7,004,237 | B2 | 2/2006 | Mathur et al. | |
| 7,413,005 | B2 | 8/2008 | Heine et al. | |
| 7,426,955 | B2 | 9/2008 | Kimura et al. | |
| 7,461,685 | B2 | 12/2008 | Overbury et al. | |
| 2002/0129926 | A1 | 9/2002 | Yamaguchi | |
| 2006/0048917 | A1 | 3/2006 | Persson | |
| 2008/0179049 | A1 | 7/2008 | Mathur et al. | |
| 2008/0210414 | A1 * | 9/2008 | Blomgren | F28D 9/005 165/166 |

FOREIGN PATENT DOCUMENTS

| | | | | |
|---|---|---|---|---|
| EP | 1154216 | A1 | 11/2001 | |
| EP | 1241428 | A2 | 9/2002 | |
| EP | 1154216 | B1 * | 4/2003 | F28D 9/0006 |
| GB | 1238491 | | 7/1971 | |
| JP | 01106768 | U | 7/1989 | |
| JP | 3-271697 | A | 12/1991 | |
| JP | 10-96596 | A | 4/1998 | |
| JP | 2000-266479 | A | 9/2000 | |
| JP | 2010164244 | A | 7/2010 | |
| KR | 2003-0071249 | A | 9/2003 | |
| KR | 1020040065282 | A | 7/2004 | |
| KR | 10-2007-0042592 | A | 4/2007 | |
| RU | 2042911 | C1 | 8/1995 | |
| SE | 524 176 | C2 | 7/2004 | |
| SU | 646880 | A3 | 2/1979 | |
| WO | 9322608 | A1 | 11/1993 | |
| WO | 2006/097116 | A1 | 9/2006 | |

OTHER PUBLICATIONS

International Search Report (PCT/ISA/210) dated Jun. 28, 2013, by the European Patent Office as the International Searching Authority for International Application No. PCT/EP2013/056990.
Written Opinion (PCT/ISA/237) dated Jun. 28, 2013, by the European Patent Office as the International Searching Authority for International Application No. PCT/EP2013/056990.
European Search Report dated Sep. 17, 2012 for European Application No. 12163320.0.
Decision on Grant dated Nov. 30, 2015, by the Federal Service for Intellectual Property in corresponding Russian Patent Application No. 2014143982 in English translation (4 pgs).
Notice of Preliminary Rejection dated Jan. 28, 2016, Korean Intellectual Property Office in corresponding Korean Patent Application No. 10-2014-7027531 in English translation (7 pgs).
Office Action issued by the Indian Patent Office on Sep. 28, 2018 in corresponding Indian Patent Application No. 1985/KOLNP/2014 (7 pages).

* cited by examiner

PLATE HEAT EXCHANGER

TECHNICAL FIELD

The invention relates to a plate heat exchanger comprising a first frame plate, a second frame plate and a stack of heat transfer plates. The heat transfer plates each have a center portion and a peripheral portion encircling the center portion. Further, the heat transfer plates are arranged in pairs between the first and the second frame plate, a first flow path for a first fluid being formed between the heat transfer plates of the pairs and a second flow path for a second fluid being formed between the pairs of heat transfer plates. One of the first and second flow paths is a free-flow path along which the center portions of the heat transfer plates are completely separated from each other.

BACKGROUND ART

Today several different types of plate heat exchangers exist, which are employed in various applications depending on their type. One certain type of plate heat exchanger is assembled by bolting a top head, a bottom head and four side panels to a set of corner girders to form a box-like enclosure around a stack of heat transfer plates. This certain type of plate heat exchanger is often referred to as a block-type heat exchanger. One example of a commercially available block-type heat exchanger is the heat exchanger offered by Alfa Laval AB under the product name Compabloc.

A block-type heat exchanger typically has fluid inlets and fluid outlets arranged on the side panels while baffles are attached to the stack of heat transfer plates for directing a fluid back and forth through channels formed between heat transfer plates in the stack of heat transfer plates.

Since the stack of heat transfer plates is surrounded by the top head, the bottom head and the four side panels, the heat exchanger may withstand high pressure levels in comparison with many other types of plate heat exchangers. Still, the block-type heat exchanger is compact, it has good heat transfer properties and may withstand hard usage without breaking.

The stack of heat transfer plates is sometimes referred to as a plate pack and has a special, block-like design that is characteristic for block-type heat exchangers. The stack of heat transfer plates is often all-welded and no gaskets are needed between heat transfer plates for proper sealing of flow channels that are formed between the plates. This makes a block-type heat exchanger suitable for operation with a wide range of aggressive fluids, at high temperatures and at high pressures.

During maintenance of the block-type heat exchanger, the stack of heat transfer plates may be accessed and cleaned by removing e.g. two side panels and flushing the stack of heat transfer plates with a detergent. It is also possible to replace the stack of heat transfer plates with a new stack, which may be identical or different from the previous stack as long as it is capable of being properly arranged within the heat exchanger.

Generally, the block-type heat exchanger is suitable not only as a conventional heat exchanger but also as a condenser or reboiler. In the two latter cases the heat exchanger may comprise additional inlets/outlets for a condensate, which may eliminate the need for a special separator unit.

In some situations, a block-type heat exchanger comprising free-flow channels for one of the fluids, i.e. channels inside which there is no contact between the heat transfer plates defining the channels, is required. For example, in applications with particularly high demands on hygiene, such as pharmaceutical applications, a plate heat exchanger with free-flow channels is often required. This is because the lack of contact points between the heat transfer plates renders the cleaning of the associated free-flow channel much easier. Further, a free-flow channel enables an ocular inspection of the complete channel to assure that it is clean. As another example, in connection with high fouling applications, free-flow channels enable handling of fluids containing fibers and solids with a relatively low risk of plugging since there are no obstacles to the flow inside the free-flow channels. Also here, the easy cleaning of the free-flow channels is of course an advantage.

The existing heat exchangers comprising free-flow channels functions very well for applications where the pressure inside the free-flow channels is higher than the pressure outside the heat exchanger. However, for applications where the pressure outside the heat exchanger is higher than the pressure inside the free-flow channels, there is a risk of deformation, more particularly compression, of at least the outermost free-flow channel. Naturally, this could negatively effect the performance of the plate heat exchanger.

SUMMARY

An object of the present invention is to provide a plate heat exchanger which, at least partly, eliminate potential limitations of prior art. The basic concept of the invention is to strengthen the stack of heat transfer plates to make it more resistant against an external relative over pressure. The plate heat exchanger for achieving the object above is defined in the appended claims and discussed below.

A plate heat exchanger according to the present invention comprises a first frame plate, a second frame plate and a stack of heat transfer plates. Each of the heat transfer plates has a center portion and a peripheral portion encircling the center portion. The heat transfer plates are arranged in pairs between the first and the second frame plate. A first flow path for a first fluid is formed between the heat transfer plates of the pairs and a second flow path for a second fluid is formed between the pairs of heat transfer plates. One of the first and second flow paths is a free-flow path along which the center portions of the heat transfer plates are completely separated from each other. The plate heat exchanger is characterized in further comprising a reinforcement plate which is thicker than the heat transfer plates and has a center portion encircled by a peripheral portion. The reinforcement plate is arranged between the first frame plate and the stack of heat transfer plates and a first number of permanent reinforcement joints each bonds together the reinforcement plate and an outermost heat transfer plate.

In a block-type heat exchanger as initially described, the first and second frame plates correspond to the top and bottom head, respectively.

Between the heat transfer plates, throughout the stack, channels are formed. The channels form flow paths; every second channel is comprised in the first flow path and the rest of the channels is comprised in the second flow path.

Since one of the first and second flow paths is a free-flow path, the channels forming this free-flow path being free-flow channels, the inventive plate heat exchanger is, as described by way of introduction, suitable for applications involving handling of fluids containing fibers and solids and applications where high demands on hygiene exists.

As compared to a "conventional" un-free, or obstructed, flow path where support points between the heat transfer plates are present, a free-flow path is weaker and more easily deformed under certain conditions. By the plate heat exchanger comprising a reinforcement plate which has a larger thickness than the heat exchanger plates and is permanently bonded to the outermost heat transfer plate, the stack of heat transfer plates, and in particular the outermost free-flow channel, is strengthened. Thereby, deformation of the free-flow path can be prevented and the field of application of the plate heat exchanger can be widened.

The plate heat exchanger may be arranged to maintain a second pressure along the free-flow path that is lower than an external pressure prevailing outside the plate heat exchanger. This pressure relationship is necessary in some plate heat exchanger applications but could lead to deformation of the free-flow path if the reinforcement plate was not present. More particularly, such a pressure relationship could lead to, seen from a center of the plate heat exchanger, inwards bulging of one or more of the heat transfer plates, including the outermost heat transfer plate, resulting in a narrowed free-flow path, if the plate heat exchanger was not constructed in accordance with the present invention. Naturally, this could jeopardize the performance of the plate heat exchanger.

Instead of just bonding together the reinforcement plate and the outermost heat transfer plate, the reinforcement joints could each bond together the reinforcement plate, the outermost heat transfer plate of the stack and a second outermost heat transfer plate of the stack. Such a connection of the reinforcement plate with two heat transfer plates increases the strength of the stack even more. Further, if each of the reinforcement joints extends through all three plates, the number of joints can be kept low as compared to if the three plates should be connected by joints which each connect two plates only. In turn, this facilitates, and reduces the cost of, the manufacturing of the plate heat exchanger.

The permanent reinforcement joints may extend in the center portions of the bonded reinforcement and heat transfer plates. This is advantageous since, along the free-flow path, the center portion of the heat transfer plates is the portion most prone to deformation, such as bulging.

As discussed above, one of the first and second flow paths is a free-flow path. The other one of the first and second flow paths may be an un-free-flow or obstructed-flow path, wherein the center portion of each of the heat transfer plates defining this obstructed-flow path comprises a second number of support areas. Each of the support areas of one of the heat transfer plates contacts a respective one of the support areas of an adjacent one of the heat transfer plates along the obstructed-flow path. As mentioned above, such obstructed-flow paths may be more resistant to deformation than a free-flow path since two heat transfer plates may cooperate to remain undeformed.

The heat transfer plates may be permanently joined to each other along the obstructed-flow path by a respective center joint between the support areas in contact with each other. Thereby, the heat transfer plates can be held together and the shape of the obstructed-flow path can remain essentially constant even in case of a higher pressure in the obstructed-flow path than outside the obstructed-flow path.

The plate heat exchanger may be so constructed that any center joints between the outermost and the second outermost heat transfer plate are comprised in the reinforcement joints, i.e. the center joints are a part of the respective reinforcement joints. Thereby, if the outermost heat transfer plate is one of the plates defining the obstructed-flow path, i.e. if the outermost channel in the stack of heat transfer plates is an obstructed-flow channel comprising support points between the heat transfer plates, the reinforcement joints connects the outermost and the second outermost heat transfer plates to each other and no separate joints for this purpose are necessary. However, if the outermost channel in the stack instead is a free-flow channel, there are no center joints between the outermost and second outermost heat transfer plates and the reinforcement joints only connect the reinforcement plate to the outermost heat transfer plate.

Each of the heat transfer plates may be pressed with a pattern comprising corrugations to provide for efficient heat transfer. Further, each of the support areas may be made by a local increased pressing depth of the heat transfer plate forming a recess on one side, and a bulge on the other side, of the heat transfer plate, a top part of this bulge constituting the support area. Thus, the support areas could be formed in the very plate pressing operation whereby no separate operation for making the support areas would be necessary.

According to one embodiment of the inventive plate heat exchanger, the reinforcement plate has projections on a side arranged to face the outermost heat transfer plate. Each of these projections is received in a respective one of the recesses of the outermost heat transfer plates. Thus, this embodiment offers a guidance for correct positioning of the reinforcement plate on the stack of heat transfer plates. At the same time a close arrangement, and thereby an easy bonding, of the reinforcement plate and the outermost heat transfer plate is enabled.

The plate heat exchanger may further comprise a third number of first inserts arranged between the peripheral portions of the outermost and the second outermost heat transfer plates. The first inserts may be arranged along two opposite edges of the heat transfer plates, aligned with the reinforcement joints. Each of the first inserts may be bonded to one or both of the outermost and second outermost heat transfer plates by a permanent first insert joint. By the provision of the first inserts, the stress in the reinforcement joints may be reduced.

The plate heat exchanger may be such that each of the first inserts form a first tooth of a respective comb shaped reinforcement means which further comprises a second tooth arranged between peripheral portions of a third and a fourth outermost heat transfer plate and a third tooth arranged between peripheral portions of a fifth and sixth outermost heat transfer plate.

The plate heat exchanger may further comprise said third number of second inserts arranged between peripheral portions of two heat transfer plates arranged closest to the second frame plate, and said third number of bars, each bar connecting a respective one of the first inserts with the opposite one of the second inserts.

The two latter constructions enable a relatively inexpensive and mechanically straight-forward plate heat exchanger.

The above discussed joints can be made by welding. Welded joints are relatively strong. Different welding techniques, such as laser welding and TIG welding, can be used for the different types of joints.

Additionally, the plate heat exchanger may comprise attachment means for demountable fastening of the reinforcement plate to the first frame plate. This set-up means that also at least the outermost heat transfer plate is fastened, indirectly though, to the first frame plate. Thereby, deformation or bending of at least the outermost heat transfer plate is counteracted which means that the free-flow path is protected even more from deformation.

The attachment means may be arranged to engage with the respective center portions of the reinforcement plate and the first frame plate. This is advantageous since the center portion of the plates is the portion most prone to deformation.

BRIEF DESCRIPTION OF THE DRAWINGS

The invention will now be described in more detail with reference to the appended schematic drawings, in which.

DETAILED DESCRIPTION

Figure 1:
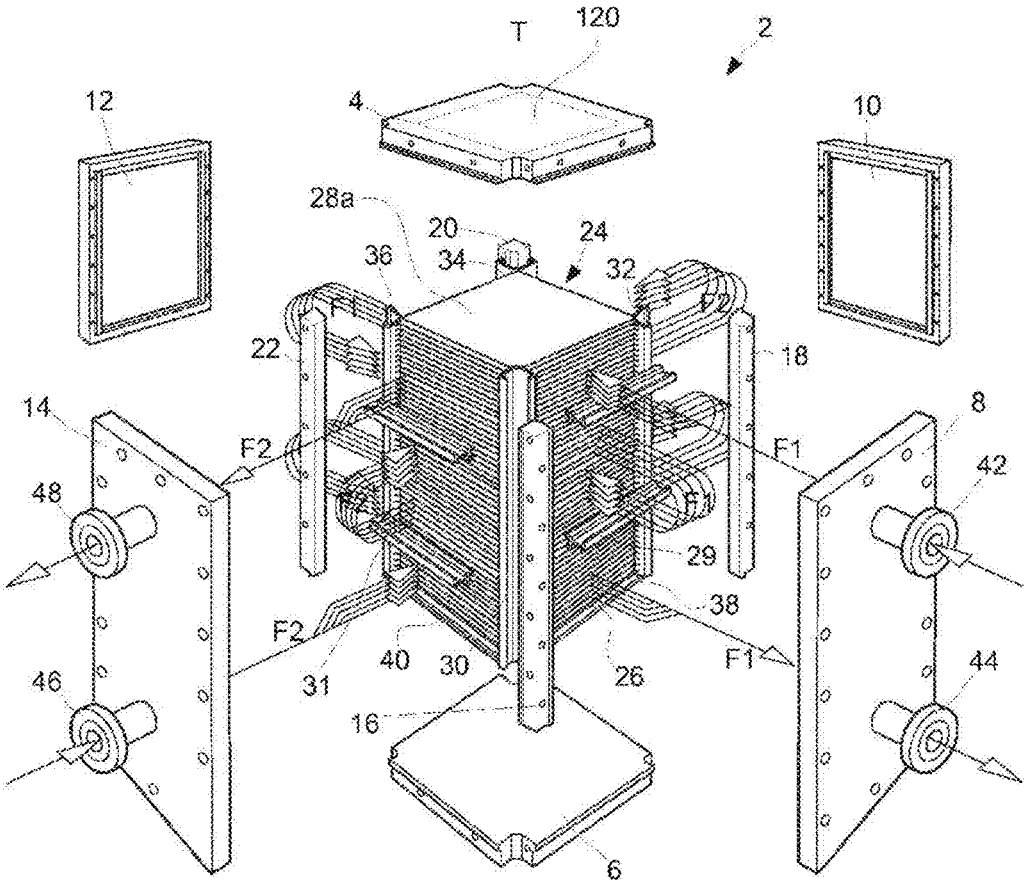
FIG. 1 is an exploded view of a block-type heat exchanger comprising a stack of heat transfer plates.

With reference to FIG. 1 a plate heat exchanger 2 of a block-type is shown. The plate heat exchanger 2 comprises a first frame plate or top head 4, a second frame plate or bottom head 6 and four side panels 8, 10, 12 and 14 that are bolted together with four corner girders 16, 18, 20 and 22 to form a parallelepiped shaped enclosure of the assembled plate heat exchanger 2. A stack 24 of aligned essentially rectangular heat transfer plates 26 of stainless steel and two rectangular reinforcement plates 28 of stainless steel (of which only one denoted 28*a* can be seen in FIG. 1) are arranged within the enclosure. The reinforcement plates 28 are aligned with the heat transfer plates 26 and attached to a respective end of the stack 24. Conventional baffles 29 and 31 are connected to sides of the stack 24 of heat transfer plates 26. The heat transfer plates, reinforcement plates and baffles will be further discussed below.

Four side linings 30, 32, 34 and 36 arranged to face a respective one of the corner girders 16, 18, 20 and 22 are arranged at a respective one of the corners of the stack 24. Further, four top linings are arranged to extend between the side linings and between one of the reinforcement plates and a respective one of the side panels 8, 10, 12 and 14. Similarly, four bottom linings are arranged to extend between the side linings and between the other one of the reinforcement plates and a respective one of the side panels 8, 10, 12 and 14. In FIG. 1, only the bottom linings have been illustrated for clarity, and only two of the bottom linings, denoted 38 and 40, are visible in this view. Gaskets (not shown) are provided so as to seal the four spaces defined by the side panels and the linings to make the plate heat exchanger leak proof. Further, the side panel 8 comprises an inlet 42 and an outlet 44 for a first fluid while the side panel 14 has an inlet 46 and an outlet 48 for a second fluid.

Figure 2:
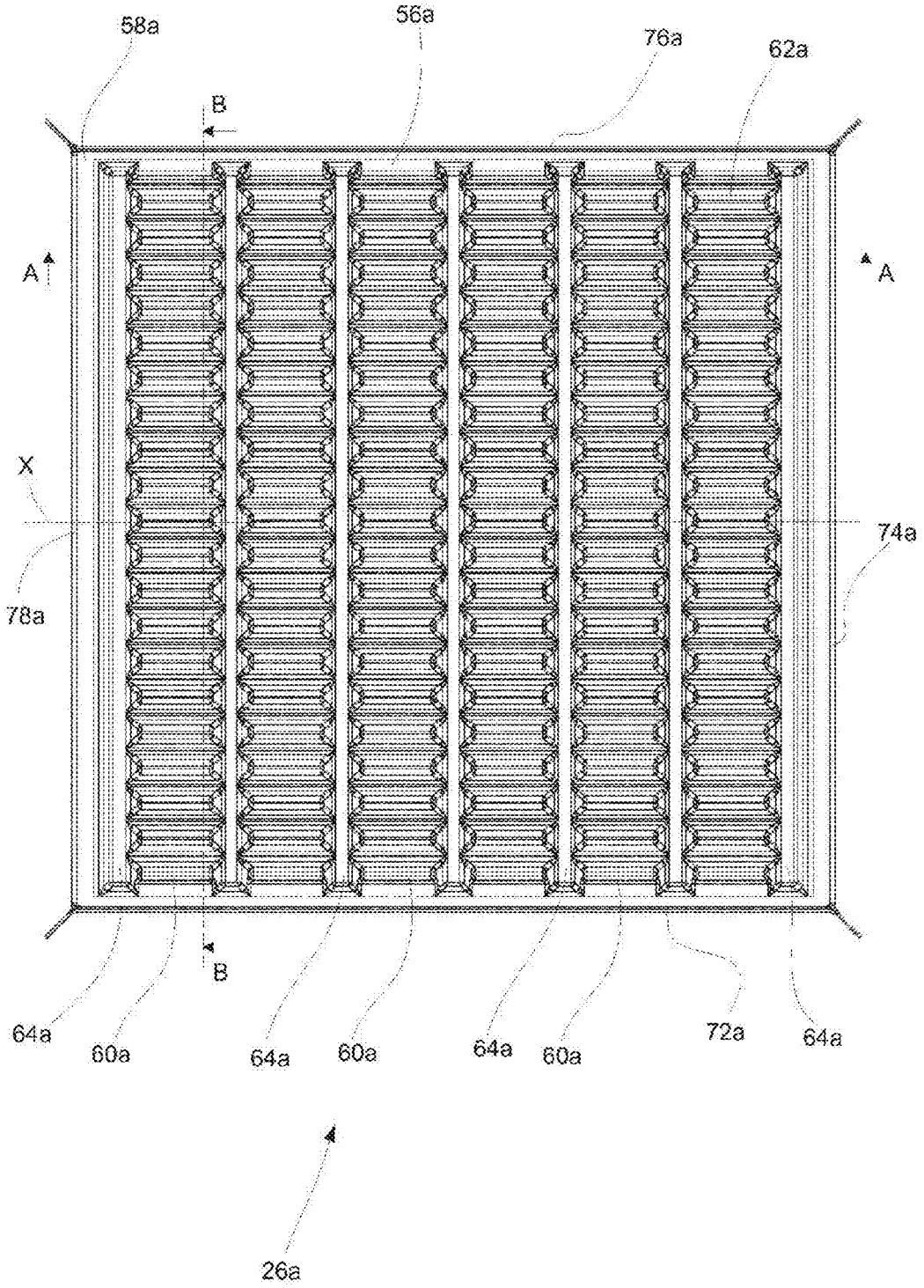
FIG. 2 is a top plan view of a part of the stack of heat transfer plates.
Figure 3:
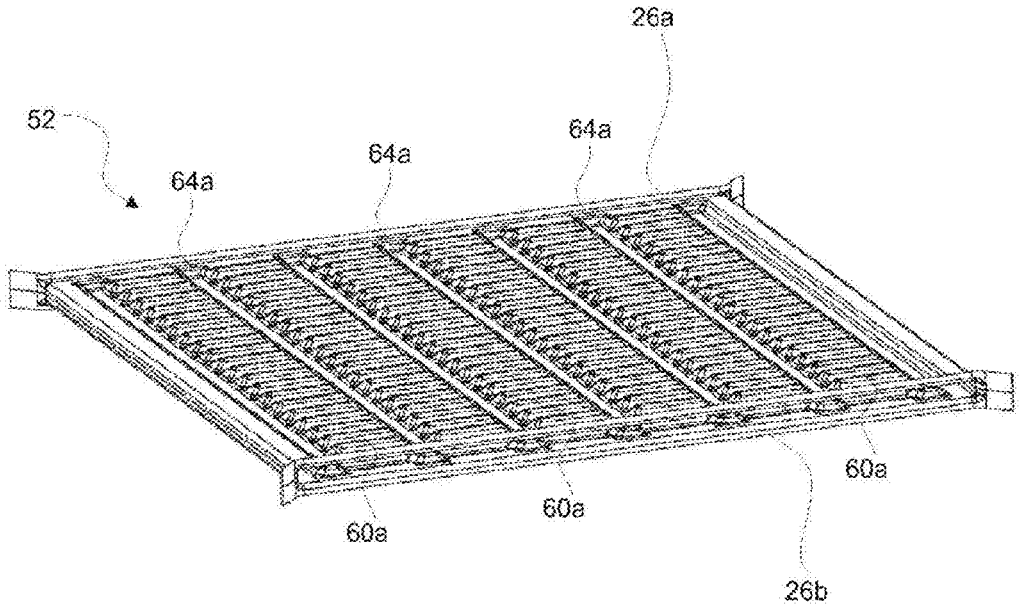
FIG. 3 is a perspective view of a cassette comprised in the stack of heat transfer plates.
Figure 4:
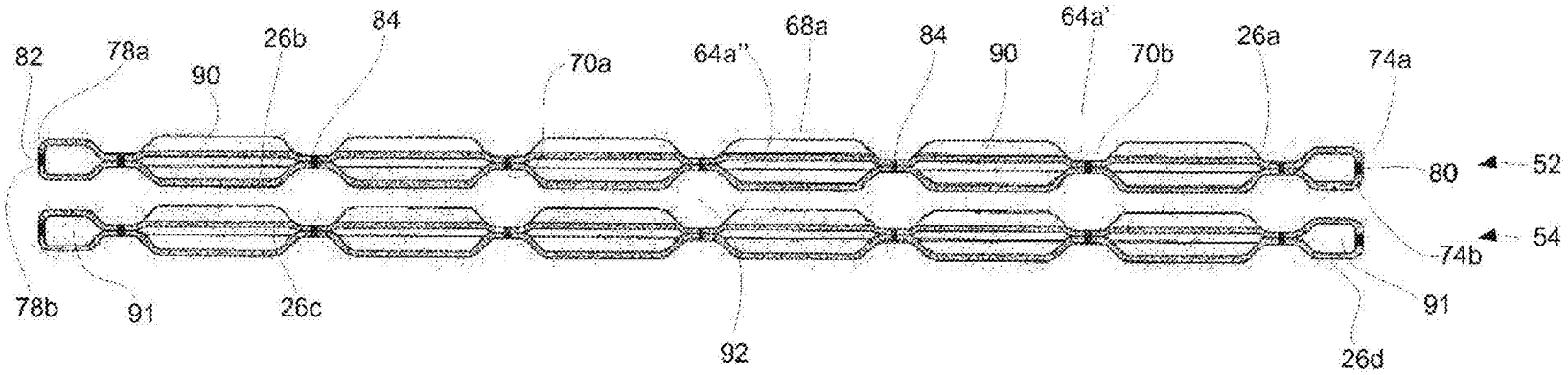
FIG. 4 is a cross-sectional view along section A-A of FIG. 2.
Figure 5:
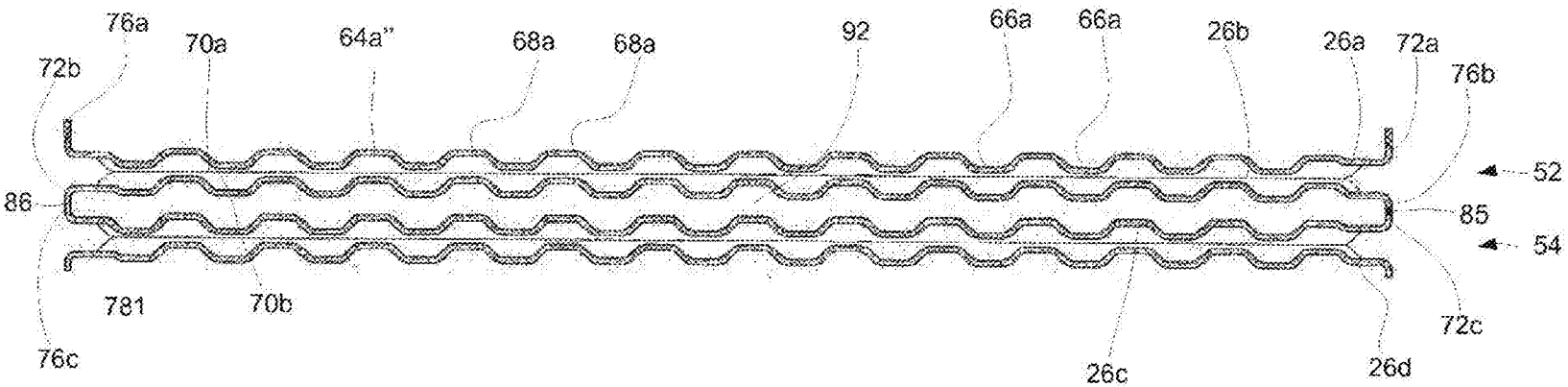
FIG. 5 is a cross-sectional view along section B-B of FIG. 2.

The heat transfer plates 26 are all essentially similar and they are arranged in pairs in the stack 24. A pair of heat exchanger plates will herein after also be denoted a cassette. A few of the heat transfer plates will now be further described with reference to FIGS. 2-5. However, the description given is just as valid for the rest of the heat transfer plates. It should be stressed that no reinforcement plate is illustrated in these figures for reasons of clarity. FIG. 3 illustrate the two, from a top T (FIG. 1) of the stack 24, outermost heat transfer plates 26*a* and 26*b* and FIGS. 2, 4 and 5 illustrate the four, from the top T of the stack 24, outermost heat transfer plates 26*a*-26*d*. These four heat transfer plates form two heat transfer plate pairs or cassettes; the outermost and the second outermost heat transfer plates 26*a* and 26*b*, respectively, form an outermost cassette 52 while the third and fourth outermost heat transfer plates 26*c* and 26*d*, respectively, form a second outermost cassette 54. In FIG. 2 only the outermost heat transfer plate 26*a* of the cassette 52 is visible. Hereinafter, the suffix 'a' is put after every reference numeral when heat transfer plate 26*a* is described, the suffix 'b' is put after every reference numeral when heat transfer plate 26*b* is described, and so on. It should be stressed that just the reference numeral, without a suffix, is used when talking about an arbitrary heat transfer plate.

The heat transfer plate 26*a* has a center portion 56*a* and a peripheral portion 58*a* encircling the center portion. The limit between the center and the peripheral portion has been illustrated with a broken line in FIG. 2. The center portion 56*a* of the heat transfer plate 26*a* is pressed with a pattern comprising six sets 60*a* of corrugations 62*a* separated by seven equidistantly arranged grooves 64*a*, a groove also being arranged on the outside of the outermost corrugation sets. Each of the grooves 64*a* extend across the complete center portion 56*a*, and parallel to two opposite edges, of the heat transfer plate 26*a*. The corrugations of the sets comprise valleys 66*a* and ridges 68*a* and are arranged in rows extending parallel to the grooves. At the grooves 64*a*, the pressing depth is locally increased to form relatively deep recesses 64'*a* on one side of the heat transfer plate 26*a*, or relatively high bulges 64"*a*, on the other side of the heat transfer plate 26*a*, as compared to the valleys 66*a* of the corrugations 62*a*. The recesses 64*a*' each has a cross sectional shape of a truncated V seen transverse an extension direction of the recesses, as apparent from FIG. 4. A respective essentially flap top part of the bulges 64*a*" constitutes a support area 70*a* of the heat transfer plate 26*a*, which will be further discussed herein below. The peripheral portion 58*a* comprises a first edge portion 72*a*, a second edge portion 74*a*, a third edge portion 76*a* and a fourth edge portion 78*a* of the heat transfer plate. Seen from the figure plane of FIG. 2, the two opposite first and third edge portions 72*a* and 76*a* are folded upwards while the two opposite second and fourth edge portions 74*a* and 78*a* are folded downwards. The orientation of the outermost heat transfer plate 26*a* is such that the first edge portion 72*a* extends adjacent to and along the side panel 8, the second edge portion 74*a* extends adjacent to and along the side panel 10, the third edge portion 76*a* extends adjacent to and along the side panel 12 and the fourth edge portion 78*a* extends adjacent to and along the side panel 14.

As mentioned above, and also apparent from the figures, the heat transfer plates are arranged in pairs or cassettes 52, 54, . . . throughout the stack, the number of cassettes being variable in dependence upon the specific application of the plate heat exchanger. Every second heat transfer plate 26*b*, 26*d*, . . . of the stack is turned, in relation to the rest of the heat transfer plates 26*a*, 26*c*, . . . , 180° around an axis X which is parallel to a plane of the top and bottom heads 4 and 6, respectively, i.e. the figure plane of FIG. 2. Thereby, in a pair of heat transfer plates, such as the pair 52, the second edge portions 74*a* and 74*b* of the heat transfer plates 26*a* and 26*b* will engage with each other while the fourth edge portions 78*a* and 78*b* of the heat transfer plates 26*a* and 26*b* will engage with each other. Further, the first edge portion 72*a* of the heat transfer plate 26*a* will be aligned with the third edge portion 76*b* of the heat transfer plate 26*b*, this first and third edge portions 72*a* and 76*b* however extending in opposite directions. Similarly, the third edge portion 76*a* of the heat transfer plate 26*a* will be aligned with the first edge portion 72*b* of the heat transfer plate 26*b*, this first and third edge portions 76*a* and 72*b* however extending in opposite directions. Additionally, each of the support areas 70*a* of the heat transfer plate 26*a* will engage with a respective one of the support areas 70*b* of the heat transfer plate 26*b*. Since each of the heat transfer plates comprises seven grooves 64, there are seven support areas 70 (second number=7) for each of the heat transfer plates.

In the stack 24, the pairs of heat transfer plates or cassettes will engage with each other. More particularly, taking the cassettes 52 and 54 as an example, the third edge portion 76*b* of the heat transfer plate 26*b* of the outermost cassette 52 will engage with the first edge portion 72*c* of the heat transfer plate 26*c* of the second outermost cassette 54. Similarly, the first edge portion 72*b* of the heat transfer plate 26*b* of the outermost cassette 52 will engage with the third edge portion 76*c* of the heat transfer plate 26*c* of the second outermost cassette 54.

The plate heat exchanger 2 is all-welded meaning that the heat transfer plates 26 of the stack 24 are permanently joined to each other by welding. The heat transfer plates of a cassette or pair are permanently joined to each other by two opposing edge plate joints, a first edge plate joint 80 extending between the engaging second edge portions 74 of the heat transfer plates of the pair, and a second edge plate joint 82 extending between the engaging fourth edge portions 78 of the heat transfer plates of the pair. Additionally, the heat transfer plates of a cassette or pair are permanently joined to each other by seven parallel center joints 84, made by laser welding. These center joints 84 extend between the engaging support areas 70 of the heat transfer plates of the pair, across the complete center portions 56 of the same.

Further, the cassettes or pairs of heat transfer plates are permanently joined to each other by two opposing edge pair joints, a first edge pair joint 85 extending between the engaging third and first edge portions 76 and 72, and a second edge pair joint 86 extending between the engaging first and third edge portions 72 and 76, of the adjacent heat transfer plates of two adjacent pairs.

Thus, the center portions 56 of the two heat transfer plates 26 of a pair or cassette, are fixed to each other along seven parallel center joints 84 and separated from each other between these center joints, whereby the channel through the cassette comprises six separate main passages 90. Actually, the channel through the cassette further comprises two outer by passages 91 along which the heat transfer plates are not corrugated. These by channels 91 are present for manufacturing purposes, do not contribute much in the heat transferring and will not be further discussed herein. Thus, the channel through the cassette is limited. The center portions 56 of the two adjacent heat transfer plates of two adjacent cassettes are completely separated from each other, whereby the channel between the cassettes is one big free passage 92. Thus, the channel between the cassettes is unlimited.

There is a first flow path F1 for a first fluid and a second flow path F2 for a second fluid through the plate heat exchanger 2. The first flow path F1 extends through the inlet 42 of the side panel 8, through the cassettes and through the outlet 44 of the side panel 8. The baffles 29 guide the flow of the first fluid back and forth through the stack 24, more particularly through the main passages 90 (and by passages 91) through the cassettes, from the inlet 42 to the outlet 44, as illustrated by the arrows in FIG. 2. Since the passability through the cassettes is limited, the first flow path F1 is referred to as an obstructed-flow path. The second flow path F2 extends through the inlet 46 of the side panel 14, between the cassettes and through the outlet 48 of the side panel 14. The baffles 31 guide the flow of the second fluid back and forth through the stack 24, more particularly through the passages 92 between the cassettes, from the inlet 46 to the outlet 48, as illustrated by the arrows in FIG. 2. Since the passability between the cassettes is unlimited, the second flow path F2 is referred to as a free-flow path. The linings 30, 32, 34 and 36 seal the corners of the stack 24, which ensures that the two different flow paths F1 and F2 are separated.

The plate heat exchanger 2 is operated with a first pressure $p_1$ along the obstructed-flow path F1, i.e. in the cassettes, and a second pressure $p_2$ along the free-flow path F2, i.e. between the cassettes, an atmospheric pressure $p_a$ prevailing outside the plate heat exchanger 2. The pressure along the free-flow path is considerably lower than the atmospheric pressure while the pressure along the obstructed-flow channel is considerably higher than the atmospheric pressure, i.e. $p_2<p_a<p_1$. The relatively high pressure along the obstructed-flow path strives to force the heat transfer plates of the cassettes away from each other. However, since the heat transfer plates of a cassette are permanently joined to each other by, not only the first and second edge plate joints 80 and 82, but also the center joints 84, the cassette can withstand the separation force caused by the first pressure $p_1$ and the shape of the obstructed-flow path can remain. The relatively low pressure along the free-flow path strives to force the adjacent heat transfer plates of two adjacent cassettes, and thus the complete cassettes, towards each other. Inside the stack of heat transfer plates, this will not cause any problem since the same pressure, i.e. the second pressure $p_2$, prevails on both sides of the cassettes. However, at the ends of the stack, i.e. at the outermost cassette 52 at the top T of the stack, and a corresponding outermost cassette at a bottom of the stack, a much higher pressure, pressure $p_a$, will prevail on the outside of cassettes than on the inside of the cassettes where pressure $p_2$ will prevail. As a result of this pressure difference, external forces directed towards an interior of the stack will be applied to the outermost cassettes. These external forces may cause an inwards bulging of the outermost cassettes and thus a deformation of the passages 92 between the outermost and the second outermost cassettes, i.e. a deformation of the free-flow path at the ends of the stack.

The presence of the reinforcement plates 28 in the plate heat exchanger 2 solves this problem. The two reinforcement plates 28 are similar. Hereinafter, the reinforcement plate arranged at the top T of the stack 24 and denoted 28*a* will be further described with reference to FIGS. 6-10. Of course, the following description is just as valid for the other reinforcement plate.

Figure 6:
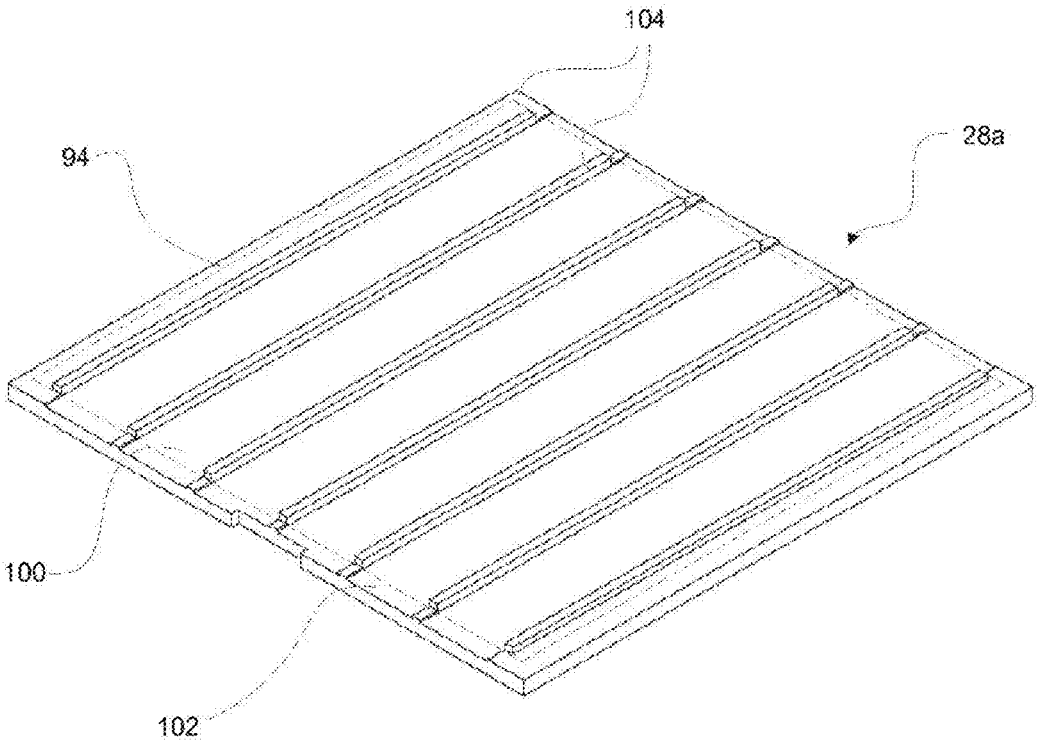
FIG. 6 is a perspective view of a reinforcement plate comprised in the plate heat exchanger of FIG. 1.

In FIG. 6 the reinforcement plate 28*a* is shown separately in a view where an underside 94 of it is clearly visible. The reinforcement plate 28*a* is arranged to be combined with the cassette 52 of FIG. 3, with the underside 94 facing the cassette 52, to form an endplate 96, which is illustrated in FIGS. 7-10. The reinforcement plate 28*a* has an essentially plane upper side 98 which is arranged to face the first frame plate or top head 4 in the assembled plate heat exchanger 2. In the assembled plate heat exchanger, a gasket will be arranged between the top head 4 and the reinforcement plate 28*a*. This gasket is not shown, nor further discussed herein.

The reinforcement plate 28*a* is solid and thicker than the heat transfer plates 26. It has a center portion 100 and a peripheral portion 102 encircling the center portion corresponding to the center and peripheral portions, 56*a* and 58*a*, respectively, of the outermost heat transfer plate 26*a*. The limit between the center and the peripheral portions has been illustrated with a broken line in FIG. 6. The reinforcement plate 28*a* comprises seven equidistantly arranged elongate projections 104 protruding from its underside 94 and extending across the complete center portion 100 and parallel to two opposing edges of the reinforcement plate 28*a*. The five most centered projections, denoted 104*a*, each has a rectangular cross section seen transverse an extension direction of the projections, as apparent from FIG. 10. Further, the two outermost projections, denoted 104*b*, each has, seen transverse an extension direction of the projections, a cross sectional shape of a trapezium with two right angles at a distal end 104*b*' of the projections to accommodate to an outer contour of the outermost heat transfer plate 26*a*, as will be further discussed below. The positions of the projections 104 of the reinforcement plate 28*a* correspond to the positions of the recesses 64*a*' of the outermost heat transfer plate 26*a* such that each of the projections 104 is received in a respective one of the recesses 64*a*' when the reinforcement plate 28*a* is arranged on the cassette 52. Further, the reinforcement plate 28*a* is so dimensioned that in the endplate 96, the distal ends 104*a*' and 104*b*' of the projections 104 of the reinforcement plate contacts bottoms of the recesses 64*a*' of the outermost heat transfer plate 26*a* while portions of the reinforcement plate between the projections contact the ridges 68*a* of the heat transfer plate 26*a* and the peripheral portion 102 of the reinforcement plate contacts the peripheral portion 58*a* of the outermost heat transfer plate 26*a*.

The reinforcement plate 28*a* is permanently joined to the outermost cassette 52 by seven parallel reinforcement joints 106 (first number=seven), made by laser welding. Each of these reinforcement joints 106 extends between one of the support areas 70*b* of the second outermost heat transfer plate 26*b* to the corresponding projection 104 of the reinforcement plate 28*a*, through the corresponding support area 70*a* of the outermost heat transfer plate 26*a*. Thus, each of the reinforcement joints 106 bonds together three plates; the reinforcement plate and the heat transfer plates of the cassette 52. Actually, the previously described center joints 84 between the outermost and second outermost heat transfer plates are comprised in, or part of, a respective one of the reinforcement joints 106. In other words, when the outermost and second outermost heat transfer plates are permanently bonded to each other, they are simultaneously bonded to the reinforcement plate to form the cassette 96. The welding operation for making the reinforcement joints is made from an underside of the second outermost heat transfer plate.

The purpose of the reinforcement plate 28*a* is, as the name implies, to strengthen the outermost cassette 52 to prevent inwards bulging of it due to the pressure condition discussed above, i.e. $p_2<p_a<p_1$, where $p_1$ is the pressure along the obstructed-flow path F1, i.e. in the cassettes, $p_2$ is pressure along the free-flow path F2, i.e. between the cassettes and $p_a$ is the atmospheric pressure prevailing outside the plate heat exchanger 2. As a result, the shape of the outermost free passage 92, i.e. the free-flow path F2, can be maintained. Since the reinforcement plate is joined to the outermost heat transfer plate by welding, the bond between the plates are strong. Thus, a limited number of reinforcement joints, here seven, is enough to keep the plates joined even under tough operational conditions. If a weaker bonding method was used, the number of joints would perhaps have to be larger and/or the joints wider. In the extreme case with a relatively weak bonding method, it could be necessary to bond the entire under surface of the reinforcement plate to the entire upper surface of the outermost heat transfer plate.

Figure 7:
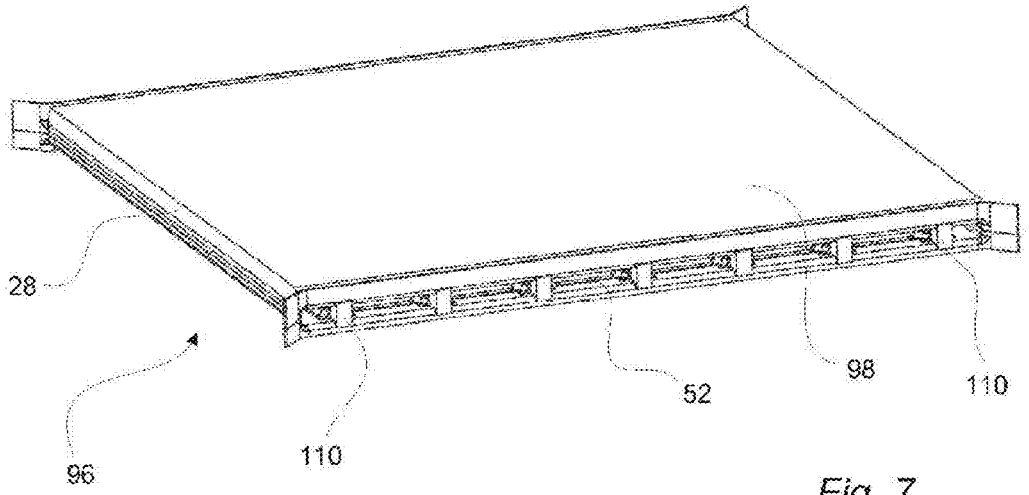
FIG. 7 is a perspective view of the reinforcement plate of FIG. 6 attached to the cassette of FIG. 3.
Figure 8:
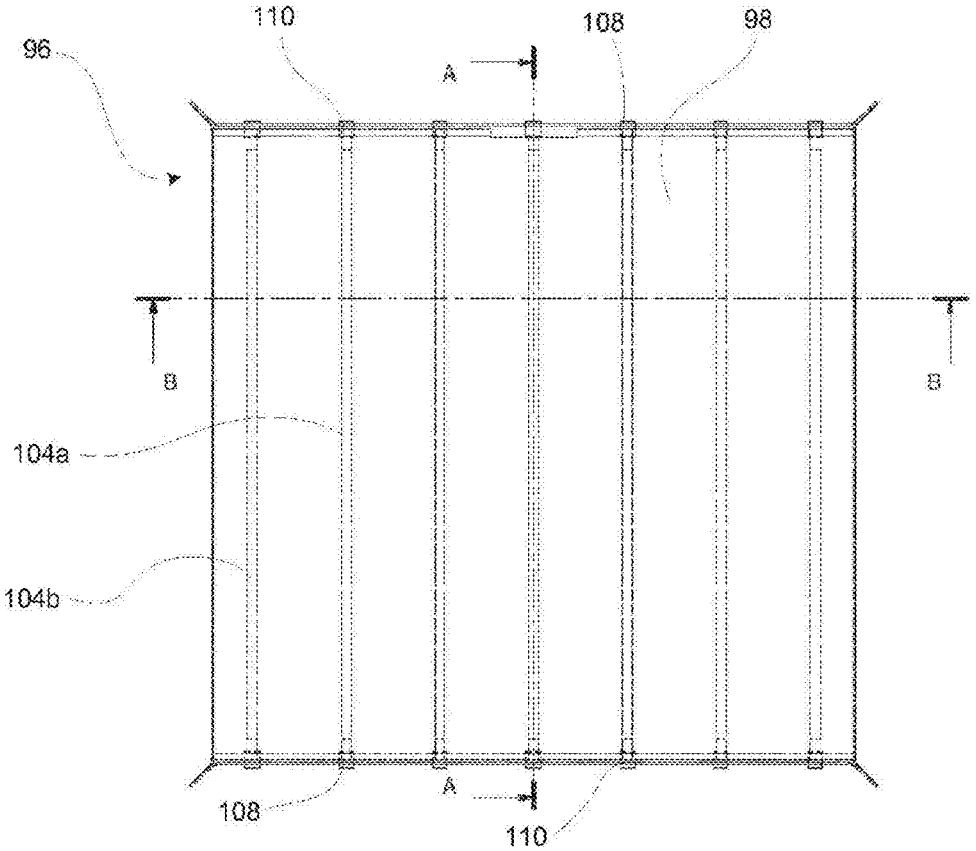
FIG. 8 is a top plan view of the reinforcement plate of FIG. 6 attached to the cassette of FIG. 3.
Figure 9:
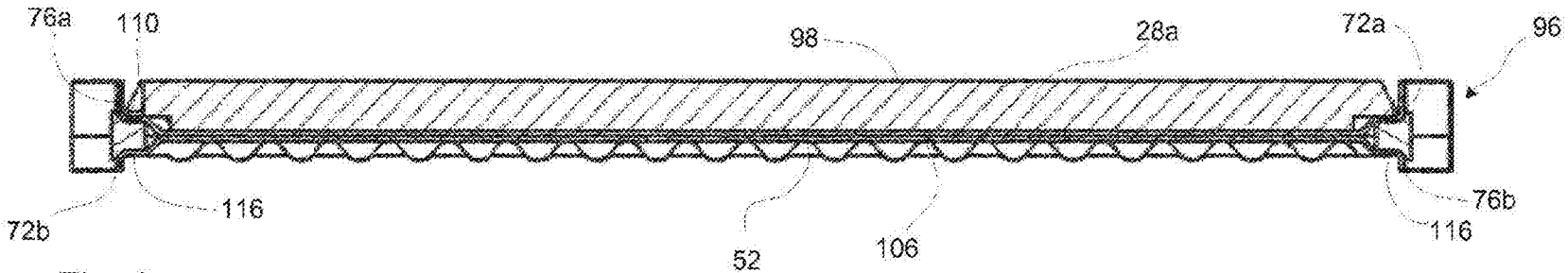
FIG. 9 is a cross-sectional view along section A-A of FIG. 8.
Figure 10:
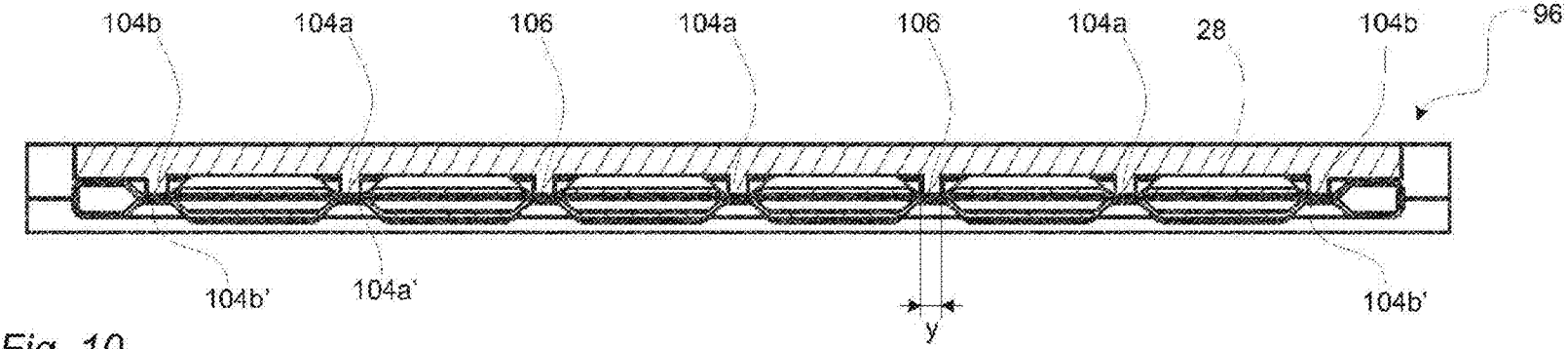
FIG. 10 is a cross-sectional view along section B-B of FIG. 8.
Figure 11:
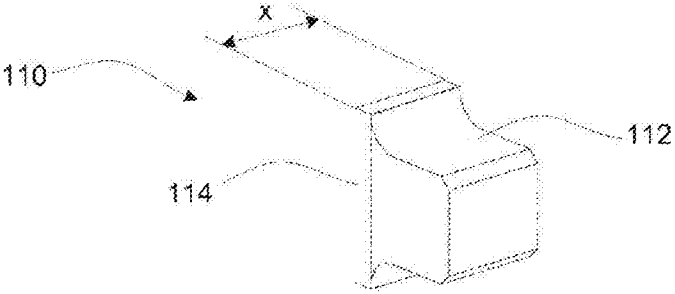
FIG. 11 is a perspective view of an first insert comprised in the plate heat exchanger of FIG. 1.

The load applied onto the reinforcement plate 28*a* due to the pressure condition above causes stress in the reinforcement joints 106. Especially in opposite ends 108 of the reinforcement joints 106 the stress can be large. This is because the load strives to separate the outermost and second outermost heat transfer plates. To decrease this stress, the plate heat exchanger further comprises a third number of first inserts 110 of stainless steel, here 14 first inserts. The first inserts 110 are all similar. One of them is separately illustrated in FIG. 11. The first inserts 110 all have a filling part 112 and a positioning part 114. They are arranged to be interposed between the outermost heat transfer plate 26*a* and second outermost heat transfer plate 26*b* of the cassette 52, as illustrated in FIGS. 7, 8 and 9. The first inserts are arranged on two opposite sides of the cassette 52, aligned in pairs with each other and with the reinforcement joints 106 and thus the support areas 70*a* and 70*b* of the heat transfer plates 26*a* and 26*b*. The first inserts have a width x which is slightly bigger than a width y of the projections 104 of the reinforcement plate 28*a*. Further, the filling part 112 of the first inserts 110 has a shape adapted to fill out the space between the peripheral portions of the outermost and second outermost heat transfer plates while the positioning part 114 of the first inserts 110 are adapted to abut against an outside of the first and third edge portions 72*a* and 76*b* of the outermost and second outermost heat transfer plates, respectively, on one side of the cassette, and an outside of the third and first edge portions 76*a* and 72*b* of the outermost and second outermost heat transfer plates, respectively, on the other side of the cassette. To remain in the correct position, the first inserts 110 are permanently fastened along first insert joints 116 made by laser welding, to the second outermost heat transfer plate 26*b*.

Thus, the outermost cassettes differ from the rest of the cassettes in the stack 24 in that the center joints between the heat transfer plates of the outermost cassettes are comprised in the reinforcement joints. This is not the case for the rest of the cassettes. The outermost heat transfer plates are also somewhat different from the rest of the heat transfer plates in that their first and third edge portions 72 and 76 are longer than the first and third edge portions of the other heat transfer plates, as is apparent from FIGS. 5 and 9. This is to accommodate to the reinforcement plates 28. For the endplate 96 it is desirable that distal edges of the first and third edge portions are flush with the upper side 98 of the reinforcement plate 28*a*.

Figure 12:
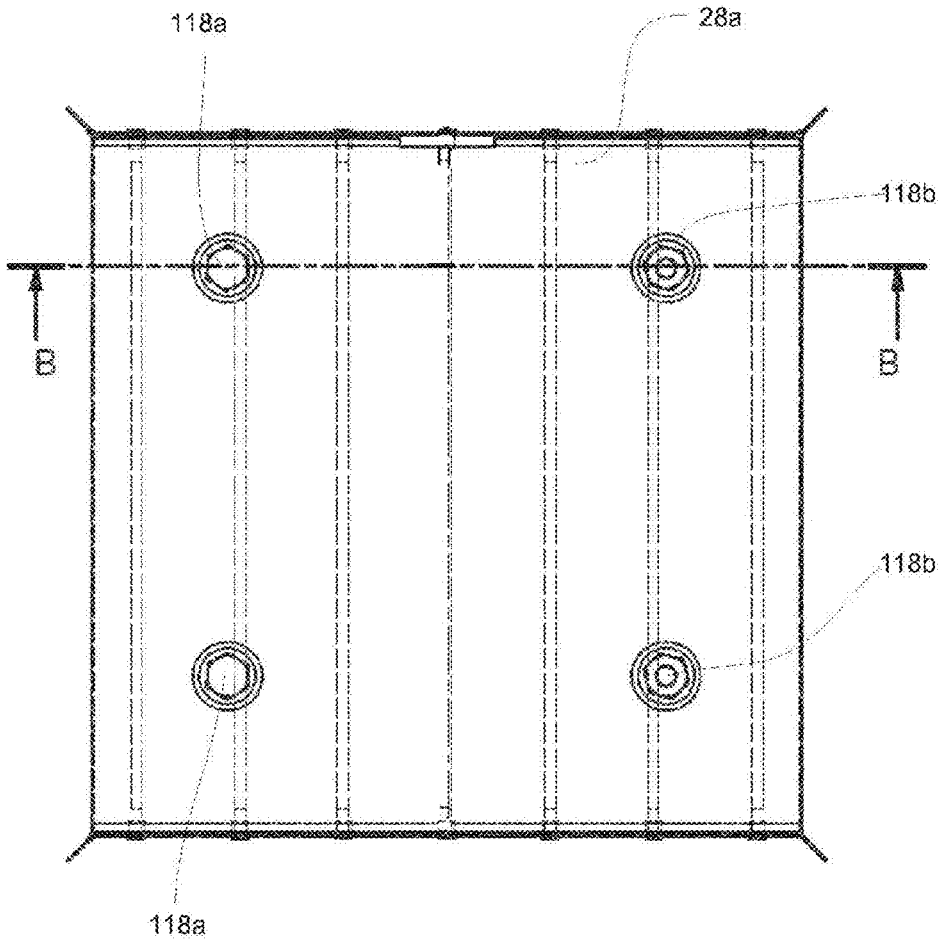
FIG. 12 is a top plan view of the reinforcement plate of FIG. 6 attached to the cassette of FIG. 3, with a complementary addition.
Figure 13:
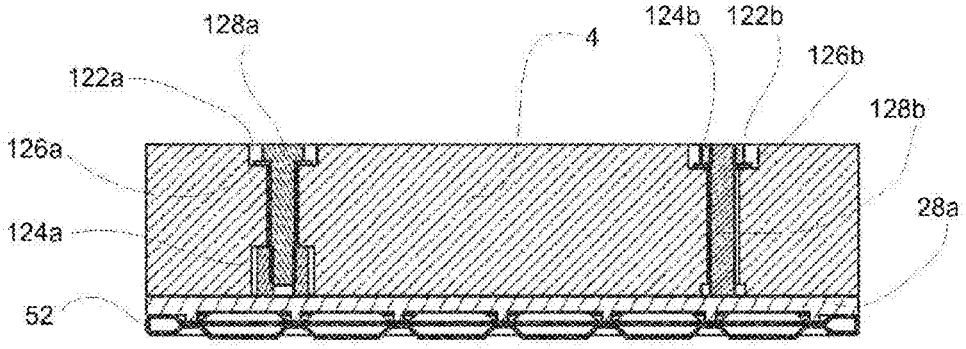
FIG. 13 is a cross-sectional view along section B-B of FIG. 12.

FIGS. 12 and 13 illustrates how the outermost cassette 52 can be strengthen even further by providing attachment means in the form of fastening devices, for demountable fastening of the reinforcement plate 28*a* to the first frame plate or top head 4. Here there are four fastening devices; two fastening devices 118*a* of a first kind and two fastening devices 118*b* of a second kind. The top head 4 has a center portion 120 (see FIG. 1) and the fastening devices are arranged to engage with and connect the center portion 120 of the top head 4 and the center portion 100 of the reinforcement plate 28*a*. There are four essentially dumbbell shaped holes through the top head 4; two holes 122*a* adapted for cooperation with the fastening devices 118*a* and two holes 122*b* adapted for cooperation with the fastening devices 118*b*. The fastening devices 118*a* each comprises a nut 124*a* welded onto the upper side 98 of the reinforcement plate 28*a* and received in a lower part of the respective hole 122*a*, a washer 126*a* seated in an upper part of the hole 122*a* and a screw 128*a* arranged through the washer 126*a*, extending through the hole 122*a* and being screwed into the nut 124*a*. The fastening devices 118*b* each comprises a nut 124*b* arranged in an upper part of the respective hole 122*b*, a washer 126*b* seated in the upper part of the hole 122*b*, a screw 128*b* welded onto the upper side 98 of the reinforcement plate 28*a*, extending through the hole 122*b* and the washer 126*b* and being screwed into the nut 124*b*. By the reinforcement plate 28*a* and thus the cassette 52 being fixed to the top head 4, the ability of the cassette 52 to withstand an external pressure force without bulging inwards increases.

The above described embodiments of the present invention should only be seen as examples. A person skilled in the art realizes that the embodiments discussed can be varied and combined in a number of ways without deviating from the inventive conception.

As an example, the plate heat exchanger could comprise other types of stress decreasing means than the above described ones. FIGS. 14 *a* & *b* and 15 schematically illustrate two such alternative types of stress decreasing means.

Figure 14A:
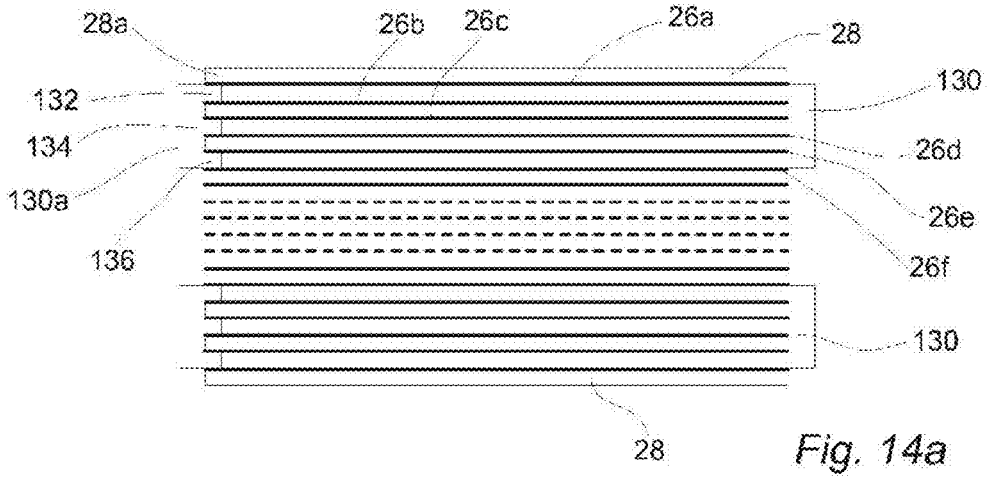
FIG. 14*a* is a schematic side view of a part of a plate heat exchanger comprising comb shaped reinforcement means.
Figure 14B:
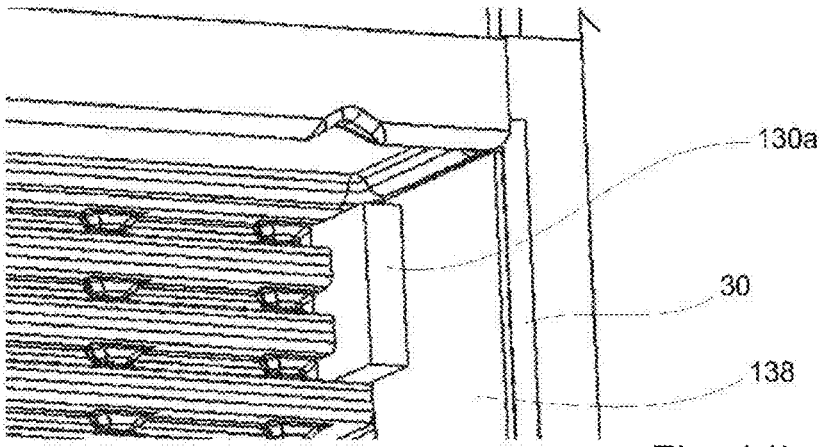
FIG. 14*b* is a perspective view of a portion of the plate heat exchanger illustrated in FIG. 14*a*.

FIGS. 14*a* and *b* illustrate a solution with comb shaped stainless steel reinforcement means 130. The plate heat exchanger here comprises eight such reinforcement means 130 (even if only four of them are visible in FIG. 14*a*), four at each of the reinforcement plates 28, one at each corner thereof. Hereinafter, the reinforcement means denoted 130*a* will be further described but it should be understood that all reinforcement means 130 have a similar construction. The reinforcement means 130*a* comprises a first insert in the form of a first tooth 132, a second tooth 134 and a third tooth 136. The first tooth 132 is arranged between the peripheral portions 58*a*, 58*b* of the first and the second outermost heat transfer plate 26*a* and 26*b*. The second tooth 134 is arranged between the peripheral portions 58*c*, 58*d* of the third and the fourth outermost heat transfer plate 26*c* and 26*d*. The third tooth is arranged between peripheral portions 58*e*, 58*f* of a fifth and a sixth outermost heat transfer plate 26*e* and 26*f*. As illustrated in FIG. 14*b*, to be held securely in place, the reinforcement means 130*a* may be welded to a support baffle 138 which is arranged in contact with the side lining 30. The support baffle 138 forms part of a so-called "Full Vacuum cage" which is a reinforcement of the side linings and possibly also the top and bottom linings of a plate heat exchanger used in vacuum applications. The "Full Vacuum cage" is not illustrated in the rest of the figures and it will not be described in detail herein.

Figure 15:
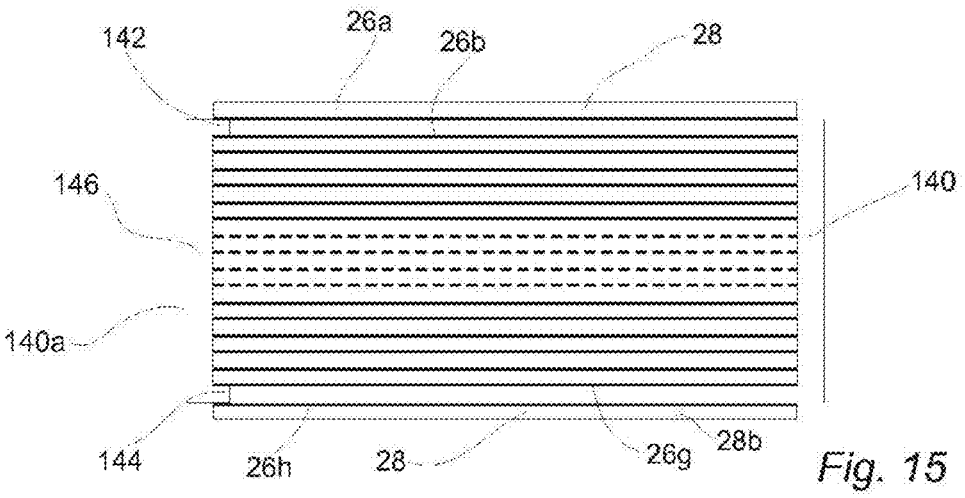
FIG. 15 is a schematic side view of a part of a plate heat exchanger comprising shackle shaped reinforcement means.

FIG. 15 illustrate a solution with shackle shaped stainless steel reinforcement means 140. The plate heat exchanger here comprises four such reinforcement means 140 (even if only two of them are visible in FIG. 15), one extending between each pair of opposite corners of the reinforcement plates 28. Hereinafter, the reinforcement means denoted 140*a* will be further described but it should be understood that all reinforcement means 140 have a similar construction. The reinforcement means 140*a* comprises a first insert 142 and an opposing second insert 144 (i.e. the third number=4) and a bar 146 connecting these. The first insert 142 is arranged between the peripheral portions 58*a*, 58*b* of the outermost and the second outermost heat transfer plates 26*a*, 26*b*. The second insert 144 is arranged between peripheral portions 58*g*, 58*h* of two heat transfer plates 26*g*, 26*h* arranged closest to the second frame plate 6, i.e. the reinforcement plate denoted 28*b*. To be held securely in place, the reinforcement means 140*a* may be welded to a support baffle of a "Full Vacuum cage" similar to the one described above (not illustrated).

Naturally, the above described alternate stress decreasing means can be varied in a great number of ways, e.g. as regards their number, number of teeth, type of engagement with other components, etc.

As another example, the invention could be used in connection with other types of heat exchangers than all-welded, block-type plate heat exchangers, for example gasketed plate heat exchangers.

Further, in the above described plate heat exchanger, the free-flow path passes between the cassettes while the obstructed-flow path passes through the cassettes. It is conceivable to reconstruct the heat transfer plates to have it the opposite way such that the free-flow path passes through the cassettes while the obstructed-flow path passes between the cassettes. In such an embodiment the reinforcement plate would be permanently bonded to the outermost heat transfer plate only since there would be a free-flow channel between the outermost and second outermost heat transfer plates.

The above described center joints between the outermost and second outermost heat transfer plates are comprised in the reinforcement joints. As an alternative, these center joints could instead be separate from the reinforcement joints. More particularly, in such an embodiment the heat transfer plates of the outermost cassette could be joined to each other by center joints similar to the center joints of all the other cassettes. Then, the reinforcement plate could be bonded to the outermost, and possibly also the second outermost, heat transfer plate along reinforcement joints in a separate operation.

In the above described embodiment the reinforcement plate and the two heat transfer plates of the outermost cassette are bonded by laser welding from en underside of the second outermost heat transfer plate. Naturally, the welding can be done in other ways and by other techniques. In connection therewith, it could be necessary to modify, for example, the design of the reinforcement and/or heat transfer plates. As an example, it could be necessary to provide the reinforcement and/or heat transfer plates with notches where the reinforcement joints should be arranged to enable the welding operation. Additionally, other techniques for achieving the above described permanent joints than welding are of course possible. One example is brazing.

Above described are continuous and straight joints. Naturally, there are many other conceivable types of joints, such as non-straight and/or non-continuous joints and spot joints. Further, above, the recesses of the heat transfer plates and the projections of the reinforcement plate are elongate and extend paralelly to each other and along the obstructed-flow path and across the complete center portions of the reinforcement and heat transfer plates. This design makes the reinforcement plate as well as the heat transfer plates relatively strong. Also, it enables continuous support along the obstructed-flow path with minimized flow-obstruction as well as strong bonding of the reinforcement plate and the heat transfer plate. However, the recess and projections could be designed in many other ways. As an example, they need not extend continuously across the center portions of the plates but may comprise interruptions. Also, the recesses and projections could be formed with other cross sections than the ones illustrated in the figures. As an example, the projections could be designed so as to fill out the entire recesses.

In the plate heat exchanger described above a pressure maintained along the free-flow path is much lower than the pressure prevailing outside the plate heat exchanger. The present invention can be used also in connection with plate heat exchangers not operating with this pressure relationship. However, the advantages given by the present invention could then be smaller. Additionally, use of the plate heat exchanger in an environment where an atmospheric pressure does not prevail is also possible, i.e. $p_a$ does not have to be the atmospheric pressure.

As used above, the term "pair" refers to the heat transfer plates of one cassette. However, "pair" could also be used as a term for two adjacent heat transfer plates forming part of two adjacent but different cassettes.

The heat transfer plates of the stack above are all essentially similar but they have two different orientations. Naturally, the heat transfer plates of the stack could instead be of different, alternately arranged, types.

The reinforcement plate above has no heat transfer function but is only present to strengthen the outermost cassette. Thus, there is no flow of fluid between the reinforcement plate and the outermost heat transfer plate. According to an alternative embodiment there could be a fluid channel between the reinforcement plate and the outermost heat transfer plate and the reinforcement plate could also function as a heat transfer plate. This fluid channel could either form part of the free-flow path or the obstructed-flow path through the plate heat exchanger.

The attachment means between the top head and the reinforcement plate can be of numerous types, the ones described above just being exemplary.

Finally, the pattern of the heat transfer plates described herein, which is described in detail in European Patent Application No. 11161423.6, filed on Apr. 7, 2011 in the name of Alfa Laval Corporate AB, and incorporated in its entirety herein by this reference, can be varied without deviating from the inventive conception.

It should be stressed that a description of details not relevant to the present invention has been omitted and that the figures are just schematic and not drawn according to scale. It should also be said that some of the figures have been more simplified than others. Therefore, some components may be illustrated in one figure but left out on another figure.

The invention claimed is:

1. A plate heat exchanger comprising: a first frame plate, a second frame plate and a stack of heat transfer plates each having a center portion and an peripheral portion encircling the center portion, the heat transfer plates being arranged in pairs between the first and the second frame plate, a first flow path for a first fluid being formed between the heat transfer plates of the pairs and a second flow path for a second fluid being formed between the pairs of heat transfer plates, wherein one of the first and second flow paths is a free-flow path along which the center portions of the heat transfer plates are completely separated from each other, further comprising a reinforcement plate which is thicker than the heat transfer plates and has a center portion encircled by an peripheral portion, the reinforcement plate being arranged between the first frame plate and the stack of heat transfer plates, the reinforcement plate possessing oppositely facing sides, one of the oppositely facing sides of the reinforcement plate facing an outermost heat transfer plate in the stack, the reinforcement plate including a plurality of projections projecting away from the one side of the reinforcement plate, the projections being spaced apart from one another and extending across the center portion of the reinforcement plate, each of the projections being bonded to the outermost heat transfer plate to define a first number of permanent reinforcement joints each bonding together the reinforcement plate and the outermost heat transfer plate and extending across the center portion of both the reinforcement plate and the outermost heat transfer plate.

2. The plate heat exchanger according to claim 1, arranged to maintain a second pressure along the free-flow path, said second pressure being lower than an external pressure prevailing outside the plate heat exchanger.

3. The plate heat exchanger according to claim 1, wherein the reinforcement joints each bond together the reinforcement plate, the outermost heat transfer plate of the stack and a second outermost heat transfer plate of the stack.

4. The plate heat exchanger according to claim 1, wherein the other one of the first and second flow paths is an obstructed-flow path, the center portion of each of the heat transfer plates defining this obstructed-flow path comprising a second number of support areas, each of the support areas of one of the heat transfer plates contacting a respective one of the support areas of an adjacent one of the heat transfer plates along the obstructed-flow path.

5. The plate heat exchanger according to claim 4, wherein the heat transfer plates are permanently joined to each other along the obstructed-flow path by a respective center joint between the support areas in contact with each other.

6. The plate heat exchanger according to claim 3, wherein any center joints between the outermost and the second outermost heat transfer plate are comprised in the reinforcement joints.

7. The plate heat exchanger according to claim 4, wherein each of the heat transfer plates is pressed with a pattern comprising corrugations, each of the support areas being made by a local increased pressing depth of the heat transfer plate forming a recess on one side, and a bulge on the other side, of the heat transfer plate, a top part of this bulge constituting the support area.

8. The plate heat exchanger according to claim 7, wherein each of the projections is received in a respective one of the recesses of the outermost heat transfer plate.

9. The plate heat exchanger according to claim 1, further comprising at least one first insert arranged between the peripheral portions of the outermost heat transfer plate and a second outermost heat transfer plate.

10. The plate heat exchanger according to claim 9, wherein the at least one first insert is arranged along two opposite edges of the heat transfer plates, aligned with the reinforcement joints.

11. The plate heat exchanger according to claim 9, wherein a respective permanent first insert joint bonds each of the at least one first insert to one of the outermost and second outermost heat transfer plates.

12. The plate heat exchanger according to claim 9, wherein each of the at least one first insert form a first tooth of a respective comb shaped reinforcement means which further comprises a second tooth arranged between peripheral portions of a third and a fourth outermost heat transfer plate and a third tooth arranged between peripheral portions of a fifth and sixth outermost heat transfer plate.

13. The plate heat exchanger according to claim 9, further comprising at least one second insert arranged between peripheral portions of two heat transfer plates arranged closest to the second frame plate, and at least one bar connecting a respective one of the first inserts with the opposite one of the second inserts.

14. The plate heat exchanger according to claim 1, wherein the projections are welded to the outermost heat transfer plate to form the permanent reinforcement joints.

15. The plate heat exchanger according to claim 1, further comprising attachment means for demountable fastening of the reinforcement plate to the first frame plate.

16. The plate heat exchanger according to claim 15, wherein the attachment means are arranged to engage with the respective center portions of the reinforcement plate and the first frame plate.

17. The plate heat exchanger according to claim 1, wherein each of the projections is an elongated projection extending parallel to two opposing side edges of the reinforcement plate.

18. A plate heat exchanger comprising: a first frame plate; a second frame plate; a stack of heat transfer plates each having a center portion and a peripheral portion encircling the center portion, the heat transfer plates being arranged in pairs between the first and the second frame plate; a first flow path for a first fluid being formed between the heat transfer plates of the pairs and a second flow path for a second fluid being formed between the pairs of heat transfer plates; one of the first and second flow paths being a free-flow path along which the center portions of the heat transfer plates are completely separated from each other; a reinforcement plate thicker than the heat transfer plates and including a center portion encircled by a peripheral portion, the reinforcement plate being arranged between the first frame plate and the stack of heat transfer plates; the reinforcement plate including a plurality of spaced apart projections; and a plurality of permanent reinforcement joints each comprised of one of the projections being bonded to an outermost one of the heat transfer plates.

* * * * *